US011390935B2

(12) United States Patent
Takebe et al.

(10) Patent No.: US 11,390,935 B2
(45) Date of Patent: Jul. 19, 2022

(54) TITANIUM ALLOY MATERIAL

(71) Applicant: NIPPON STEEL CORPORATION, Tokyo (JP)

(72) Inventors: Hidenori Takebe, Tokyo (JP); Sosuke Nishiwaki, Tokyo (JP); Tomonori Kunieda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/962,356

(22) PCT Filed: Feb. 7, 2018

(86) PCT No.: PCT/JP2018/004216

§ 371 (c)(1),
(2) Date: Jul. 15, 2020

(87) PCT Pub. No.: WO2019/155553

PCT Pub. Date: Aug. 15, 2019

(65) Prior Publication Data

US 2020/0347484 A1 Nov. 5, 2020

(51) Int. Cl.

| | |
|---|---|
| ***C22C 14/00*** | (2006.01) |
| ***C21D 8/02*** | (2006.01) |
| ***C22F 1/18*** | (2006.01) |

(52) U.S. Cl.

CPC ..... *C22C 14/00* (2013.01); *C21D 8/0226* (2013.01); *C21D 8/0236* (2013.01); *C21D 8/0273* (2013.01); *C22F 1/183* (2013.01)

(58) Field of Classification Search

CPC ..... C21D 8/0226; C21D 8/0236; C21D 8/0273; C22C 14/00; C22F 1/00; C22F 1/183

USPC ..... 420/417

See application file for complete search history.

(56) References Cited

U.S. PATENT DOCUMENTS

| | | | | |
|---|---|---|---|---|
| 9,797,029 | B2 * | 10/2017 | Fujii | C22C 14/00 |
| 10,913,242 | B2 * | 2/2021 | Kunieda | B23K 15/0046 |
| 2012/0267001 | A1 | 10/2012 | Otsuka et al. | |

FOREIGN PATENT DOCUMENTS

| | | | |
|---|---|---|---|
| EP | 2 520 677 | A1 | 11/2012 |
| JP | 2005-298970 | A | 10/2005 |
| JP | 2009-30140 | A | 2/2009 |
| JP | 2009-68026 | A | 4/2009 |
| JP | 4819200 | B2 | 11/2011 |

(Continued)

OTHER PUBLICATIONS

NPL: on-line translation of JP 2013001973 A, Jan. 2013 (Year: 2013).*

(Continued)

*Primary Examiner* — Jie Yang

(74) *Attorney, Agent, or Firm* — Birch, Stewart, Kolasch & Birch, LLP

(57) ABSTRACT

A titanium alloy material contains: in mass %, Cu: 0.7% to 1.4%; Sn: 0.5% to 1.5%; Si: 0.10% to 0.45%; Nb: 0.05% to 0.50%; Fe: 0.00% to 0.08%; O: 0.00% to 0.08%; and the balance composed of Ti and impurities, in which in a structure, an area fraction of an α phase is 96.0% or more and an area fraction of an intermetallic compound is 1.0% or more, and an average crystal grain size of the α phase is 10 μm or more and 100 μm or less and an average grain size of the intermetallic compound is 0.1 to 3.0 μm.

2 Claims, 1 Drawing Sheet

(56) References Cited

FOREIGN PATENT DOCUMENTS

| | | | | |
|---|---|---|---|---|
| JP | 2013001973 | A | * | 1/2013 |
| WO | WO 2010/054236 | A1 | | 5/2010 |

OTHER PUBLICATIONS

International Search Report for PCT/JP2018/004216 dated May 15, 2018.
Written Opinion of the International Searching Authority for PCT/JP2018/004216 (PCT/ISA/237) dated May 15, 2018.

* cited by examiner

TITANIUM ALLOY MATERIAL

TECHNICAL FIELD

The present invention relates to a titanium alloy material excellent in high-temperature strength and forming workability that is used suitably for exhaust system components and so on, for example.

BACKGROUND ART

Stainless steel excellent in corrosion resistance, strength, workability, and so on has been used for a composing member of an exhaust device in a four-wheel vehicle and a two-wheel vehicle (to be referred to as automobiles, or the like, below) conventionally, but in recent years, titanium materials that are lighter than stainless steel, have high strength, and are also excellent in corrosion resistance are being used. For example, for the exhaust device of the two-wheel vehicle, a titanium material defined in JIS type 2 (what is called, industrial pure titanium) has been used. Further, recently, in place of the titanium material defined in JIS type 2, a titanium alloy material having higher heat resistance has been used. Further, in recent years, mufflers equipped with catalysts used at high temperatures have also been used to remove harmful components of exhaust gas.

The exhaust device of automobiles, and so on is provided with an exhaust manifold and an exhaust pipe. The exhaust pipe is composed of divided several parts to accommodate a catalyst device with a catalyst mounted or applied and a muffler in the middle of the pipe. In this description, the entire part from the exhaust manifold to the exhaust pipe and an exhaust port is referred to as an "exhaust device." Further, components composing the exhaust device are referred to as "exhaust system components." Combustion gas emitted from an engine of an automobile, or the like is collected by the exhaust manifold to be exhausted from the exhaust port at the rear of the vehicle through the exhaust pipe. The exhaust device is exposed to high-temperature exhaust gas, so that the titanium material forming the exhaust device is required to have strength and corrosion resistance in a high-temperature range. Further, these components of the exhaust device are complicated in shape, so that forming workability at room temperature is also required.

Patent Document 1 describes a heat-resistant titanium alloy material for exhaust system components that is excellent in oxidation resistance and contains Cu, Sn, Si, and O, the total content of Cu and Sn being 1.4 to 2.7%, and the balance composed of Ti and inevitable impurities. Further, in Patent Document 1, a titanium alloy containing the above-described components is hot rolled and further is cold rolled to be annealed at 750 to 830° C., and thereby the heat-resistant titanium alloy material for exhaust system components is manufactured.

Further, Patent Document 2 describes a heat-resistant titanium alloy plate excellent in cold workability that contains Cu, 0, and Fe and the balance composed of Ti and 0.3% or less of impurities. In Patent Document 2, a titanium alloy containing the above-described components is subjected to steps of hot rolling, hot-rolled sheet annealing, cold rolling, intermediate annealing, final annealing, and so on, and the final annealing is performed at a temperature of 600 to 650° C., and thereby the heat-resistant titanium alloy plate excellent in cold workability is manufactured.

Further, Patent Document 3 describes a heat-resistant titanium alloy material for exhaust system components that is excellent in oxidation resistance and formability and contains Cu, Si, and O and the balance composed of Ti and inevitable impurities. In Patent Document 3, a titanium alloy containing the above-described components is subjected to steps of hot rolling, hot-rolled sheet annealing, cold rolling, final annealing, and so on, and the final annealing is performed at a temperature of 630 to 700° C., and thereby the heat-resistant titanium alloy material for exhaust system components excellent in oxidation resistance and workability is manufactured.

However, even with the titanium alloy materials described in Patent Document 1 to Patent Document 3, compatibility between strength in a high-temperature zone and forming workability at room temperature was not sufficient.

PRIOR ART DOCUMENT

Patent Document

[Patent Document 1] Japanese Patent No. 4819200

[Patent Document 2] Japanese Laid-open Patent Publication No. 2005-298970

[Patent Document 3] Japanese Laid-open Patent Publication No. 2009-68026

DISCLOSURE OF THE INVENTION

Problems to be Solved by the Invention

The present invention has been made in consideration of the above-described circumstances, and has an object to provide a titanium alloy material excellent in high-temperature strength and forming workability at room temperature and a manufacturing method thereof.

Means for Solving the Problems

The gist of the present invention is as follows.

[1]

A titanium alloy material contains: in mass %,

Cu: 0.7% to 1.4%;

Sn: 0.5% to 1.5%;

Si: 0.10% to 0.45%;

Nb: 0.05% to 0.50%;

Fe: 0.001% to 0.08%;

O: 0.001% to 0.08%; and the balance composed of Ti and impurities, in which in a structure, an area fraction of an α phase is 96.0% or more and an area fraction of an intermetallic compound is 1.0% or more, and an average crystal grain size of the α phase is 10 μm or more and 100 μm or less and an average grain size of the intermetallic compound is 0.1 to 3.0 μm.

[2]

The titanium alloy material according to [1], further contains: one or both of in mass %, Bi: 0.1 to 2.0%; and Ge: 0.1 to 1.5%, in which a total content of one or both of Bi and Ge is less than 3.0%.

[3]

The titanium alloy material according to [1], in which fracture elongation at 25° C. is 25.0% or more, 0.2% proof stress at 25° C. is 340 MPa or less, and a tensile strength at 700° C. is 60 MPa or more.

Effect of the Invention

According to the present invention, it is possible to provide a titanium alloy material excellent in high-temperature strength and forming workability at room temperature. This titanium alloy material is excellent also in oxidation resistance and appearance after forming.

MODE FOR CARRYING OUT THE INVENTION

Figure 1:
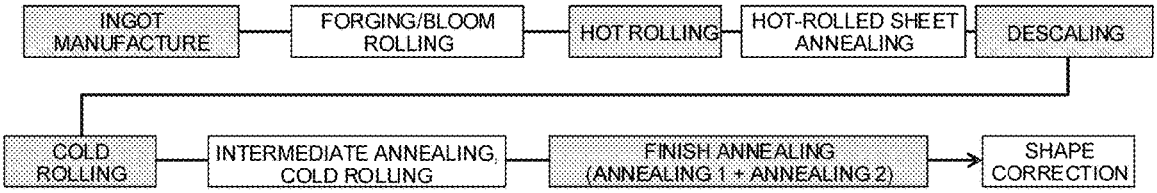
FIG. 1 is a flow diagram illustrating one example of a manufacturing method of a titanium alloy material according to this embodiment.

The present invention will be explained in detail below.

Adding alloying elements and solid-solution strengthening them are normally performed in order to improve the high-temperature strength of a titanium alloy material. However, the titanium alloy material having improved high-temperature strength increases in strength even at room temperature, so that springback at a forming work time increases, leading to a decrease in formability. For example, in order to automate welding, or the like to efficiently manufacture products such as an exhaust device, reducing positional displacement caused by springback is required. Incidentally, in this description, the room temperature is 20° C. to 30° C. The room temperature is preferably 25° C.

For suppressing the springback, increasing a Young's modulus or reducing strength, particularly, 0.2% proof stress is effective. For increasing the Young's modulus, adding Al or O or developing a texture is required, but this hinders ductility or press formability itself of the material not just the springback. Thus, the inventors studied a method to increase strength at high temperatures while reducing strength at room temperature, to then learn using elements with solid solubility limits that differ greatly depending on temperature. Thereby, the inventors came to invent a titanium alloy material that has low strength at room temperature at which forming is performed due to the precipitation of added elements and is capable of securing high-temperature strength by precipitates being solid-dissolved when used in a high-temperature range.

Here, the above-described 0.2% proof stress is explained. The titanium alloy material exhibits or does not exhibit a yield phenomenon in a tensile test. In the case where the titanium alloy material does not exhibit the yield phenomenon, it is necessary to define a stress equivalent to a yield stress as a proof stress in order to clarify the boundary between elastic deformation and plastic deformation for convenience. In general, the permanent strain at the time of yielding of steel is about 0.002 (0.2%), and thus the stress at which the permanent strain at an unloading time becomes 0.2% is referred to as 0.2% proof stress and this is used in place of the yield stress also in the description of the present application.

In order to ensure the formability, it is preferable to increase the average crystal grain size of the α phase to increase ductility. At this time, if an intermetallic compound remains in a structure, the intermetallic compound hinders the grain growth of the α phase, so that it is preferable to perform annealing in a relatively high-temperature range where the intermetallic compound does not precipitate to promote the grain growth of the α phase.

On the other hand, when the added alloying elements are solid-dissolved in the metal structure, the metal structure is solid-solution strengthened, the 0.2% proof stress improves, the springback is likely to occur, and the formability at room temperature is hindered, so that it is preferred that a certain amount of intermetallic compound should exist. For precipitation of the intermetallic compound, annealing only needs to be performed for a long time in a temperature range lower than the temperature range where the α phase grows. The precipitation of the intermetallic compound can be performed by later-described second annealing (a precipitation treatment of the intermetallic compound).

Here, when annealing is performed in order to increase the crystal grain size of the α phase after the intermetallic compound is formed, the previously precipitated intermetallic compound is re-solid-dissolved in the metal structure by the annealing, failing to secure the formability at room temperature. Thus, it is necessary to perform the annealing intended for increasing the crystal grain size of the α phase first, and then to perform the annealing intended for precipitating the intermetallic compound.

Further, the metal structure of the titanium alloy receives roll reduction force by cold rolling, so that the structure obtained after the cold rolling becomes a structure elongated in the rolling direction. Accordingly, the annealing intended for controlling the average crystal grain size of the α phase needs to be performed after the cold rolling.

As has been explained above, in the present invention, it is desired to perform the annealing intended for controlling the average crystal grain size of the α phase after the cold rolling, and then to perform the annealing intended for precipitating the intermetallic compound.

The titanium alloy material obtained by going through these steps has a structure in which the crystal grain size of the α phase is relatively large and the intermetallic compound is precipitated, so that it is possible to ensure the formability at room temperature. Further, since the added alloying elements each having a large solid solubility limit such as Cu and Sn are contained, the intermetallic compound is solid-dissolved in the metal structure at a high-temperature and the 0.2% proof stress improves, resulting in that it is possible to increase the high-temperature strength.

The titanium alloy material according to the present invention is suitably used as a component material of the exhaust system component of the exhaust device in automobiles, two-wheel vehicles, and so on, in particular. The titanium alloy material is formed and worked into various exhaust system components and these exhaust system components are combined, to thereby manufacture the exhaust device. Thereafter, the exhaust device is mounted in an automobile, or the like to be used. By the exhaust device being used, the titanium alloy material being a component material is exposed to high-temperature exhaust gas to be heated to a high temperature. In the titanium alloy material according to the present invention before being heated to a high temperature, namely at room temperature, the intermetallic compound exists in the metal structure and the average crystal grain size of the α phase is relatively large, so that the strength is low, the forming workability improves, and the springback at a forming work is also reduced. Thereafter, as a result that the titanium alloy material is exposed to high-temperature exhaust gas to be heated to a high temperature when the exhaust device is used, the intermetallic compound existing in the metal structure at a forming work time is solid-dissolved to be solid-solution strengthened, thereby ensuring excellent high-temperature strength. In the titanium alloy material according to the present invention, as an index of the forming workability at room temperature, fracture elongation at 25° C. is set to 25.0% or more and 0.2% proof stress at 25° C. is set to 340 MPa or less. Further, as an index of the high-temperature strength, a tensile strength at 700° C. is set to 60 MPa or more.

Hereinafter, there will be explained in detail a titanium alloy material being an embodiment of the present invention.

First, there will be explained contents of component elements. Here, "%" for the components means mass %. Further, a chemical composition is an analysis value not of an ingot but of a titanium alloy material that has been subjected to up to finish annealing (Cu: 0.7% to 1.4%)

Cu is an element that has a large solid solubility limit and improves high-temperature strength and strength at room temperature. For improving the high-temperature strength, containing 0.7% or more is required. When Cu is contained excessively, an intermetallic compound such as $Ti_2Cu$ precipitates in large amounts, leading to deterioration in ductility. Further, when used, a β phase is formed when the temperature exceeds 780° C., so that there is a concern that the high-temperature strength decreases. Further, when a precipitation amount of $Ti_2Cu$ is large, the grain growth of the α phase is hindered to make the grains fine, to thereby reduce the ductility at room temperature. Therefore, the upper limit of the content of Cu is set to 1.4% or less. Accordingly, the content of Cu is set to 0.7% to 1.4%. The lower limit of Cu may be 0.8%, 0.9%, or 1.0%. Further, the upper limit of Cu may be 1.3%, 1.2%, or 1.1%.

(Sn: 0.5% to 1.5%)

Sn is an element that has a large solid solubility limit and improves high-temperature strength. For improving the high-temperature strength, containing 0.5% or more of Sn is required. Further, Si to be described later improves high-temperature strength and oxidation resistance, but is likely to cause segregation when manufacturing a product by using a large ingot, and is unsuitable for using a large ingot for suppressing a manufacturing cost. Therefore, it is necessary to reduce variation in the high-temperature strength by adding Sn with small segregation. Incidentally, when Sn is contained excessively, the precipitation of the intermetallic compound such as $Ti_2Cu$ is promoted, so that limiting to 1.5% or less is required. Accordingly, the content of Sn is set to 0.5% to 1.5%. The lower limit of Sn may be 0.6%, 0.7%, or 0.8%. Further, the upper limit of Sn may be 1.4%, 1.3%, or 1.2%.

(Si: 0.10% to 0.45%)

Si is an element that improves high-temperature strength and oxidation resistance. When considering also the segregation, however, in order to obtain these effects, containing 0.10% or more of Si is required. When Si is contained excessively, the effects of improving the high-temperature strength and the oxidation resistance are reduced relative to the content, and further an intermetallic compound (silicide) is precipitated in large amounts to reduce the ductility at room temperature, and thus, the upper limit is set to 0.45% or less. Accordingly, the content of Si is set to 0.10% to 0.45%. The lower limit of Si may be 0.15%, 0.20%, or 0.25%. Further, the upper limit of Si may be 0.40%, 0.35%, or 0.30%.

(Nb: 0.05% to 0.50%)

Nb is an element that improves oxidation resistance. Further, Nb is an element of less segregated comparing Si, within an addition range of the invention. Therefore, in order to reduce variation in the oxidation resistance caused by the segregation of Si, adding Nb is also required. In order to obtain the effect of improving the oxidation resistance, adding 0.05% or more of Nb is required. When Nb is contained excessively, the effect of improving the oxidation resistance is reduced relative to the content to facilitate formation of the β phase. Further, Nb is expensive, so that the upper limit is set to 0.50% or less. Accordingly, the content of Nb is set to 0.05% to 0.50%. The lower limit of Nb may be 0.10%, 0.15%, or 0.20%. Further, the upper limit of Nb may be 0.40%, 0.35%, or 0.30%.

(Fe: 0.00% to 0.08%)

Fe is an element to be contained inevitably. Further, Fe is a β stabilizing element, and when contained excessively, Fe facilitates formation of the β phase and hinders the growth of crystal grains of the α phase. In order to obtain sufficient ductility at room temperature, it is necessary to grow the crystal grains of the α phase, so that a smaller content of Fe is preferred. Accordingly, the content of Fe is set to 0.00% to 0.08%. The upper limit of Fe may be 0.06%, 0.04%, or 0.02%.

(O: 0.00% to 0.08%)

O is an element to be contained inevitably, improves strength at room temperature, and reduces ductility. O hardly contributes to the strength at high temperatures, so that its smaller content is preferred. Accordingly, the content of 0 is set to 0.00% to 0.08%. The upper limit of O may be 0.06, 0.04%, or 0.02%.

The balance of the titanium alloy material in this embodiment is Ti and other impurities other than the above. The impurity elements other than Fe and O are C, N, H, Cr, Al, Mo, Zr, Mn, V, and Ni, and when the content of these impurities is large, the ductility at room temperature decreases. Accordingly, the upper limit of each of the impurity elements is desirably set to 0.05% or less. Further, the total content of these impurity elements is desirably set to less than 0.3%.

[Regarding Selection Elements]

The titanium alloy material in this embodiment may contain, in place of a part of Ti, one or both of Bi and Ge within a range where the total content is less than 3.0%. The upper limit of one or both of Bi and Ge may be 2.5%, 2.0%, or 1.5%.

(Bi: 0.1% to 2.0%)

Bi has a certain level of solid solubility limit at high temperatures, and 0.1% or more of Bi may be contained in order to improve the high-temperature strength. However, Bi generates an intermetallic compound similarly to Cu and Si to reduce the ductility at room temperature, so that the upper limit is set to 2.0% or less. The lower limit of Bi may be 0.2%, 0.3%, or 0.4%. Further, the upper limit of Bi may be 1.5%, 1.0%, or 0.8%.

(Ge: 0.1% to 1.5%)

Ge has a certain level of solid solubility limit at high temperatures, and 0.1% or more of Ge may be contained in order to improve the high-temperature strength. However, Ge generates an intermetallic compound similarly to Cu and Si to reduce the ductility at room temperature, so that the upper limit is set to 1.5% or less. The lower limit of Ge may be 0.2%, 0.3%, or 0.4%. Further, the upper limit of Ge may be 1.2%, 1.0%, or 0.8%. When Bi and Ge are added in combination, their solid solubility limits both become small, and thus when 2.0%, which is the upper limit of each element, is each added (4.0% in total), an intermetallic compound is formed. Therefore, unless the total added amount of Bi and Ge is 3.0% or less, the ductility is impaired by intermetallic compounds in large amounts.

As above, the titanium alloy material in this embodiment has the chemical composition containing the above-described basic elements and the balance composed of Ti and impurities, or a chemical composition containing the above-described basic elements, at least one selected from the above-described selection elements, and the balance composed of Ti and impurities.

[Area Fraction of the α Phase and Area Fraction of the Intermetallic Compound]

The titanium alloy material in this embodiment makes the intermetallic compound precipitate in the metal structure at room temperature, to thereby suppress the solid-solution strengthening, reduce the 0.2% proof stress, and improve the forming workability. In order to obtain this effect, the intermetallic compound needs to be precipitated in the titanium alloy material at an area fraction of 1.0% or more. However, when the intermetallic compound is precipitated too much, the ductility at room temperature is sometimes reduced by precipitation strengthening, and thus the area fraction of the intermetallic compound is set to 4.0% or less. The area fraction of the intermetallic compound may be 3.0% or less or 2.0% or less. Further, the area fraction of the α phase is set to 96.0% or more. The lower limit of the area fraction of the α phase may be 97.0% or 98.0%.

The measurement of the area fraction here is performed by image-analyzing a reflected electron image of a region of 500 μm×500 μm (250000 $\mu m^2$) or more of a thickness center portion in an L-cross section while using a scanning electron microscope. The measurement region is not limited to one visual field, and 250000 $\mu m^2$ or more in total of a plurality of visual fields may be secured. The reflected electron image has regions that are whiter or blacker than the parent phase, and thus, the area fraction of these regions is found as an intermetallic compound. These white regions or black regions appear at grain boundaries or intra granular of the α phase. Each black portion is where an element having a small atomic number is concentrated, and is, for example, a Ti—Si based intermetallic compound. The white region of the reflected electron image is where an element having a large atomic number is concentrated, and is, for example, a Ti—Cu based intermetallic compound. In the meantime, in the titanium alloy material, the β phase sometimes exists other than the α phase and the intermetallic compound. The β phase is also displayed as a white region in the reflected electron image similarly. It is difficult to separate the intermetallic compound and the β phase in this white region only by the reflected electron image. For the separation, it is necessary to confirm the presence or absence of concentration of Fe to be concentrated in the β phase by an EPMA (Electron Probe Micro Analyzer) or EDX (Energy Dispersive X-ray spectrometry). However, in the titanium alloy in this embodiment, the β phase does not exist, or even if the β phase exists, its area fraction is 0.2% or less. In the titanium alloy in this embodiment in which the α phase is set as the first phase, the β phase only needs to be recognized as the second phase together with the intermetallic compound. That is, in the case where the β phase is contained, the area fraction of the β phase may be included in the area fraction of the intermetallic compound.

[Average Crystal Grain Size of the α Phase]

The titanium alloy material in this embodiment improves the ductility at room temperature to reduce the 0.2% proof stress by increasing the crystal grain size of the α phase. Therefore, the average crystal grain size of the α phase, which is the main phase, needs to be 10 μm or more. When it is smaller than 10 μm, the 0.2% proof stress becomes too high or elongation becomes insufficient in some cases. It is more preferably 12 μm or more and further preferably 15 μm or more. As the average crystal grain size is larger, the ductility at room temperature is more excellent, but when it exceeds 100 μm, wrinkling occurs by forming and the appearance may be impaired. Accordingly, the upper limit of the average crystal grain size of the α phase needs to be set to 100 μm. It is desirably 70 μm or less and more desirably 50 μm or less.

Incidentally, the average crystal grain size of the α phase is found by an intercept method using a structure photograph obtained by observing the vicinity of the thickness center in an L-cross section by an optical microscope or a scanning electron microscope. Concretely, in a region of 200 μm×200 μm or more, five line segments each having a length Ln (200 μm or more) whose longitudinal direction is the rolling direction are drawn at intervals of 30 μm or more in the thickness direction, a number Xn of crystal grains divided by each of the line segments is measured, a crystal grain size Dn of each of the line segments is found by (1) Equation, and the average crystal grain size is found by an average value D of the crystal grain sizes Dn in (2) Equation. The crystal grain completely intersected by the line segment is counted as one, and the case where the line segment is broken in the crystal grain is counted as 0.5.

$$Dn(\mu m)=Ln/Xn \quad (1)$$

$$D(\mu m)=(D_1+D_2+D_3+D_4+D_5)/5 \quad (2)$$

[Average Grain Size of the Intermetallic Compound]

In the titanium alloy material in this embodiment, the intermetallic compound is precipitated at a predetermined area fraction, and thereby, the solid solution amount of the intermetallic compound in the α phase decreases and the 0.2% proof stress at room temperature decreases. The precipitated intermetallic compound is exposed to high temperature, to thereby be solid-dissolved in the α phase again, so that the high-temperature strength improves. When being coarse, the precipitated intermetallic compound is not easily solid-dissolved when being exposed to high temperature, failing to obtain sufficient high-temperature strength, and thus it is necessary to set the average grain size of the intermetallic compound to 3.0 μm or less. However, when dispersion is too fine, the effect of precipitation strengthening increases and the ductility decreases. Therefore, the lower limit of the average grain size of the intermetallic compound is set to 0.1 μm. Incidentally, as the intermetallic compound in this embodiment, not only intermetallic compounds composed of titanium and other metallic elements such as $Ti_2Cu$ and titanium silicide, but also intermetallic compounds composed of metallic elements other than titanium are included. A scanning electron microscope is used for observing the grain size of the intermetallic compound. A measurement range is the same as that in the case of the area fraction of the intermetallic compound, but when measuring each intermetallic compound, the measurement is preferably performed at a magnification of 1000 times as an indication and measurement at a higher magnification is also preferred.

[Manufacturing Method]

Next, there will be explained one example of a manufacturing method of the titanium alloy material according to this embodiment with reference to FIG. 1. The flow of a manufacturing step is illustrated in FIG. 1. In FIG. 1, ingot manufacture, hot rolling, descaling, cold rolling, and finish annealing (annealing 1+annealing 2) are essential steps, and forging/bloom rolling, hot-rolled sheet annealing, intermediate annealing and cold rolling, and shape correction are steps to be performed according to need.

[Hot Rolling]

As a material to be hot rolled, an ingot having the above-described chemical composition, which is cast by a method such as vacuum arc melting or electron beam melting, is used. Incidentally, the forging/bloom rolling may be added before hot rolling. The forging/bloom rolling is performed by performing heating to 1000° C. or more (1050° C. or more desirably). In the hot rolling, heating is performed at 800 to 1100° C. to perform rolling. When a hot rolling temperature falls below 800° C. at this time, a deformation resistance increases to make the hot rolling difficult to be performed. When the temperature exceeds 1100° C., oxidation becomes severe and scale indentations or scale parts by hot rolling increase, thereby leading to a decrease in yield.

[Hot-Rolled Sheet Annealing]

The hot-rolled sheet annealing is performed for the purpose of facilitating cold rolling by reducing strain of the titanium alloy material obtained after the hot rolling. However, this step is not necessarily performed and may be performed in the case where a cold-rolling property is insufficient. The hot-rolled sheet annealing is performed at 750 to 850° C. for suppressing excessive oxidation to suppress the decrease in the yield. An annealing time is not limited in particular, but holding for 1 minute to 60 minutes is enough.

[Cold Rolling]

The cold rolling is performed after descaling is performed following the hot rolling or the hot-rolled sheet annealing. The descaling may be performed by a general method, which is a method of removing a surface layer by pickling with a mixed acid of nitric acid and hydrofluoric acid after performing shot blasting, for example. In the cold rolling, it is necessary to increase a total rolling ratio in cold working (a cold rolling ratio) for obtaining a uniform structure, and the cold rolling ratio is desirably 50% or more. On the other hand, when the cold rolling is performed so that the cold rolling ratio exceeds 95%, edge cracking to greatly reduce the yield occurs, so that the upper limit of the cold rolling ratio is set to 95% or less. It is more preferably 90% or less and further preferably 85% or less. In the case where the intermediate annealing is performed, the cold rolling ratio of the cold rolling after the intermediate annealing only needs to be set to 50% or more. Incidentally, the intermediate annealing is desirably performed at 750 to 850° C. similarly to the hot-rolled sheet annealing.

Next, on the titanium alloy material obtained after the cold rolling, the finish annealing is performed. The first annealing is performed at 750 to 830° C., and further, the second annealing is performed at 550 to 720° C. The annealing is performed for two times, and thereby a target metal structure is obtained. Incidentally, cold rolling is not performed between the first annealing and the second annealing

[First Annealing (Solution Treatment)]

The first annealing (to be referred to as the annealing 1 below) is performed for the purpose of coarsening crystal grains of the α phase while solid-dissolving the intermetallic compound. Therefore, the annealing needs to be performed at 750° C. or more. The titanium alloy material in this embodiment contains the alloying elements in large amounts in order to increase the high-temperature strength, and when the temperature is lower than 750° C., the intermetallic compound is precipitated to hinder the grain growth of the α phase and coarsening the grains becomes difficult. Therefore, a long time is required for coarsening the grains and the precipitated intermetallic compound becomes coarse. Further, even in the second annealing, the already-existing intermetallic compound grows, resulting in formation of a coarse intermetallic compound. In the meantime, when an annealing temperature exceeds 830° C., the β phase is formed, to thus hinder the growth of the crystal grains of the α phase. Further, in the case of 750° C. or more, when batch annealing is performed, coils are joined at their contact portion to cause seizing, and thus it is inappropriate. Therefore, the annealing 1 is performed by continuous annealing. Accordingly, the annealing 1 is performed at 750° C. to 830° C. by continuous annealing in order to control the average crystal grain size of the α phase to a predetermined range. A preferable range is 770 to 820° C. and a more preferable range is 780 to 810° C. Cooing after the annealing 1 may be air cooling, furnace cooling, or the like because a precipitation rate of $Ti_2Cu$, which is one of the intermetallic compounds, is extremely slow. An average cooling rate down to 550° C. or less is preferably 0.5° C./s and more preferably 1° C./s. When the temperature falls below 550° C., a precipitation reaction becomes very slow, and thus it is not necessary to pay special attention to a cooling rate in a zone lower than 550° C. Even if holding is performed for less than one minute, at the above-described annealing temperature, the intermetallic compound starts to be solid-dissolved and the crystal grains in the α phase are brought into a state where they can grow. Therefore, the annealing 1 is performed for about one minute as a guide, and may be adjusted according to a facility so as to make the average crystal grain size of the α phase fall within a desired range (10 μm to 100 μm). An annealing time of the annealing 1 may be one to five minutes concretely.

[Second Annealing (Precipitation Treatment of the Intermetallic Compound)

In the titanium alloy material obtained after undergoing the above-described annealing 1, the intermetallic compound is hardly precipitated, and even if it is precipitated, the area fraction of the intermetallic compound is less than 1.0%. In the case where the intermetallic compound remains solid-dissolved, the 0.2% proof stress increases due to the solid-solution strengthening, and thus the titanium alloy material is not excellent in the forming workability. Accordingly, the intermetallic compound is made to precipitate so as to obtain a predetermined area fraction, to thereby suppress the solid-solution strengthening and reduce the 0.2% proof stress. In this embodiment, in order to make the intermetallic compound precipitate at a predetermined area fraction, the second annealing (to be referred to as the annealing 2, below) is performed at 550 to 720° C. after the annealing 1.

When the temperature of the annealing 2 exceeds 720° C., the solid solubility limits of Cu and Si in the α phase increase, and thus the precipitation amount of the intermetallic compound decreases, failing to obtain a sufficient effect of reducing the 0.2% proof stress. Further, when the temperature is less than 550° C., element diffusion is suppressed, to thus make the precipitation of the intermetallic compound insufficient or make the precipitated intermetallic compound fine, leading to an increase in the 0.2% proof stress. Therefore, the annealing 2 is performed within a range of 550 to 720° C. Further, in order to make the intermetallic compound precipitate sufficiently, an annealing time of the annealing 2 needs to be set to four hours or more. It is preferably eight hours or more. The upper limit of the annealing time is not necessarily limited in particular, but from the viewpoint of productivity, it is 50 hours or less and more preferably 40 hours or less. Further, the intermetallic compound is in a state of being already precipitated sufficiently, and even if the cooling rate slows down, the precipitation amount of the intermetallic compound increases only a little, and thus no special attention is required and furnace cooling is enough.

Figure 2:
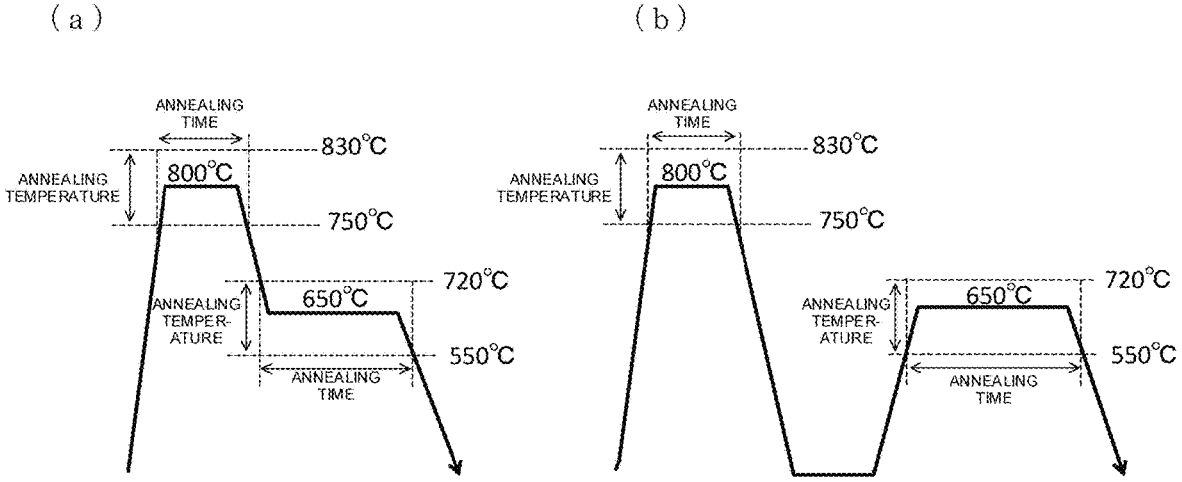
FIG. 2(*a*) FIG. 2(*b*) are explanatory views of annealings 1, 2.

In the manufacturing method of the titanium alloy material according to this embodiment, after the annealing 1 at 750° C. or more and 830° C. or less, the annealing 2 at 550° C. or more and 720° C. or less is performed. As illustrated in FIG. 2(*a*), for example, it is also possible that cooling is performed down to the temperature close to room temperature after the annealing 1, and thereafter heating is performed to perform the annealing 2. Further, as illustrated in FIG. 2(*b*), it is also possible that after the annealing 1, cooling is performed down to the temperature range of the annealing 2 and then the annealing 2 is performed directly.

Incidentally, in the case where the annealing 1 is performed and then, standing-to-cool (what is called furnace cooling) is performed for a long time in a heating furnace, the titanium alloy material passes through the range of 550 to 720° C. being the annealing temperature of the annealing 2, but in this case, it is impossible to maintain the range of 550 to 720° C. for four hours or more, resulting in that the titanium alloy material passes through this temperature range for less than four hours. Accordingly, only the furnace cooling after the annealing 1 makes sufficient precipitation of the intermetallic compound difficult.

By the above steps, the titanium alloy material according to this embodiment is manufactured.

According to the titanium alloy material in this embodiment, it is possible to provide a titanium alloy material excellent in high-temperature strength and forming workability at room temperature. Further, the titanium alloy material in this embodiment is manufactured by performing, on the ingot having a predetermined chemical composition, hot rolling and cold rolling, and then two-stage annealing. By the first annealing, the crystal grain size of the α phase in the titanium alloy becomes 10 μm or more, and by the second annealing, the area fraction of the intermetallic compound becomes 1.0% or more and the area fraction of the α phase becomes 96.0% or more. The titanium alloy material in this embodiment has such a metal structure and contains the added elements each having a large solid solubility limit, so that it is possible to improve the forming workability while maintaining the high-temperature strength and suppressing the 0.2% proof stress at room temperature.

Example

Next, examples of the present invention will be explained, and the conditions in the examples are one condition example employed to confirm the enablement and effects of the present invention, and the present invention is not limited to the one condition example. The present invention can employ various conditions as long as the object of the present invention is achieved without departing from the gist of the present invention.

No. 1-1 to No. 1-3, No. 2-1 to No. 2-3, No. 3-1, No. 3-2, No. 4, No. 5-1, No. 5-2, No. 6-1, No. 6-2, No. 7 to No. 9, No. 11 to No. 14, No. 15-1 to No. 15-3, No. 16-1 to No. 16-3, No. 17-1, No. 17-2, No. 18-1 to No. 18-22, No. 19-1 to No. 19-5, No. 20-1, No. 20-2, and No. 21 to No. 30 other than No. 10 were each fabricated by using an about 0.6-kg ingot by vacuum arc button melting. Further, No. 10 was fabricated by using an about 20-kg ingot by vacuum arc melting. Each of the fabricated ingots was hot rolled at 1000° C. to obtain a hot-rolled sheet having a thickness of 10 mm. Thereafter, hot rolling was performed at 860° C., and thereby a hot-rolled sheet having a thickness of 4 mm was obtained.

Thereafter, a descaling step was performed, or hot-rolled sheet annealing was performed at a temperature and for a time, the temperature and the time being described in Tables 1, 2, and then a descaling step was performed, and then cold rolling with a cold rolling ratio set to 71.4% was performed and a thin sheet having a thickness of 1 mm was obtained. Thereafter, annealing 1 and annealing 2 were performed at an annealing temperature and for an annealing time, the annealing temperature and the annealing time being in Tables 1, 2, and then a structure observation and a tensile test were performed. After the annealing 1 step, air cooling was performed, and after the annealing 2 step, furnace cooling was performed. Further, No. 1-1 to No. 30 other than No. 23 and No. 24 were cooled down to room temperature (25° C.) after the annealing 1, and then were heated to be subjected to the annealing 2. On No. 1-1 to No. 30 fabricated by the above steps, a tensile test, a structure observation, and an appearance evaluation after working were performed. Incidentally, chemical compositions illustrated in Tables 1, 2 each indicate a value obtained by analyzing a sheet material that has undergone the cold rolling and the finish annealing. Further, other impurities indicate the total content of C, N, H, Cr, Al, Mo, Zr, Mn, and Ni. Properties of the respective sheet materials are illustrated in Tables 3, 4.

[Room-Temperature Tensile Test]

The tensile test at room temperature (25° C.) was performed in which an ASTM half-size tensile test piece with the longitudinal direction being parallel to the rolling direction (parallel part width 6.25 mm, parallel part length 32 mm, gauge length 25 mm) was taken from the above-described thin sheet and a strain rate was 0.5%/min up to a strain of 1.5% and then was 30%/min until fracture. The ductility and the springback at room temperature were evaluated by the fracture elongation and the 0.2% proof stress at room temperature. The case where the fracture elongation at room temperature is 25.0% or more and the 0.2% proof stress at room temperature is 340 MPa or less was determined as a pass because the ductility was sufficient and the springback was small. Incidentally, the tensile test was performed in a room maintained at an average temperature of 25° C. (±2° C.) by an air conditioner.

[High-Temperature Tensile Test]

The tensile test at high temperatures was performed in which a tensile test piece with the longitudinal direction being parallel to the rolling direction (parallel part width 10 mm, parallel part length and gauge length 30 mm) was taken from the above-described thin sheet, and the strain rate was 0.3%/min up to a strain of 1.5% and then was 7.5%/min until fracture. A test atmosphere was set to the atmosphere at 700° C., a test piece was held in the test atmosphere for 30 minutes so as to sufficiently reach a test temperature, and then the test was performed. The case where the tensile strength at high temperatures is 60 MPa or more was determined as a pass because of being excellent in the high-temperature strength.

[Structure Observation]

An L-cross section (TD plane) of the above-described thin sheet was observed by an optical microscope, and the average crystal grain size of the α phase was found by an intercept method The α phase and the intermetallic compound were distinguished from the contrast in the structure in a reflected electron image observed by a scanning electron microscope.

The area fraction of the α phase was found by image processing the area fraction of the α phase. As for the area fraction of the intermetallic compound, the area fraction of the intermetallic compound was found from an area of a portion other than the α phase. The average grain size of the intermetallic compound was found by calculating an area per one from the number of grains of the portion other than the α phase and the area of the portion other than the α phase and square-approximating the calculated area. The crystal grain size of the α phase is the average crystal grain size found by the intercept method. The case where the average crystal grain size of the α phase found by the above method is 10 μm to 100 μm, the case where the area fraction of the α phase is 96% or more, and the case where the area fraction of the intermetallic compound is 1.0% or more were determined as a pass because they satisfied the conditions of the present invention. Results of the tensile test and the structure observation described above are illustrated in Table 1. Incidentally, each underline in tables indicates that it deviates from the condition or the property defined in this embodiment.

[Appearance Evaluation after Working]

A spherical stretch forming test using a 50 μm-thick Teflon sheet as a lubricant was performed until a dome height reached 15 mm, and an appearance wrinkle occurrence degree was observed to be evaluated on four scales of A, B, C, D ("Teflon" is a registered trademark). A is set as one having an appearance equal to that of a conventional material (JIS H4600 type 2 titanium), B is set as one that is inferior in appearance to the conventional material but has wrinkles removable by polishing after commercialization of product, C is set as one that requires a step of blasting or the like before polishing, D is set as one that has wrinkles unremovable by polishing even after blasting or the like is performed. D is a failure. Incidentally, in the case of fracture at 15 mm, the dome height may be reduced to 13 mm or 10 mm and determination may be performed by comparative evaluation with the conventional material (JIS H4600 type 2 titanium). Incidentally, as the conventional material, there was used a sheet material obtained in a manner that a hot-rolled sheet (having a thickness of 4 to 5 mm) manufactured from an ingot having a chemical composition of JIS H4600 type 2 titanium was subjected to descaling by shot blasting and pickling, a flawless portion of the hot-rolled sheet formed by up to hot rolling was cold rolled to a thickness of 1 mm, and then a rolling oil was washed and removed with an acetone or alkaline solution, and then the cold-rolled portion was subjected to 8-h vacuum annealing at 650° C.

[Oxidation Test]

An oxidation test was evaluated by a value (oxidation increase) obtained by dividing a weight increase, which was obtained by wet polishing a surface of about a sheet thickness×20 mm×40 mm with an emery paper #600 and performing holding in the atmosphere at 800° C. for 100 h, by a surface area of a test piece. Incidentally, at the time of the test, the surface of the test piece was sufficiently exposed to the atmosphere by leaning the test piece against a container or the like. The case where the oxidation increase is 50 g/m$^2$ or less was determined to be excellent in the oxidation resistance. Note that, the oxidation increase is an index representing the oxidation resistance, and a smaller oxidation increase indicates more excellent oxidation resistance. When oxidation occurs, oxygen is bonded to titanium, so that the weight increases. In the case where oxide scales are exfoliated, the weight decreases, but in the case where the scales are exfoliated, the exfoliated scales are also collected and the weight is measured therewith. Therefore, the test is performed in such a manner that the test piece is placed in such a container as to enable collection even if scales are exfoliated.

In No. 1-1 to No. 1-3, No. 2-1 to No. 2-3, No. 3-1, No. 3-2, and No. 4, the high-temperature strength was insufficient regardless of with or without the two-stage annealing, because the contents of Cu, Sn, and Si were small. In No. 5-1 and No. 5-2, the content of Nb is small and the oxidation increase is large. Further, No. 5-2 has a rough skin problem in terms of the appearance evaluation because rough skin appears hard on a parallel part of the test piece after the tensile test. Also in No. 6-2, the rough skin became severe because of the crystal grain size being large.

In No. 7, 8, 10, and 11, the content of the alloying elements was too large, and thus the grains were made fine and the high-temperature strength or the ductility decreased. In No. 9, the crystal grain size was 10 μm or more, but the content of Si was too large, and thus the intermetallic compound increased and the ductility decreased. In No. 12, the content of oxygen was too large, and thus not only the high-temperature strength but also the ductility decreased.

No. 16-2, No. 18-2, No. 18-3, and No. 18-22 each are an example where the annealing 1 (solution treatment) was performed but the annealing 2 (precipitation treatment of the intermetallic compound) was not performed, and thus the intermetallic compound was not precipitated very much and the 0.2% proof stress increased too much. Further, in No. 18-2, the holding time was shorter than that in No. 18-3, so that the grains were made fine and therefore the 0.2% proof stress more increased.

No. 16-3 and No. 18-4 to No. 18-20 each are an example where the annealing 1 was not performed but the annealing 2 was performed. In No. 18-4, No. 18-5, No. 18-6, No. 18-7, No. 18-10, No. 18-12, No. 18-16, and No. 18-20, the annealing 2 was performed at a temperature higher than 720° C. and the average crystal grain size of the α phase was 10 μm or more. However, in No. 18-4, No. 18-5, No. 18-6, No. 18-7, No. 18-10, No. 18-12, and No. 18-16, the precipitation of the intermetallic compound becomes insufficient and the 0.2% proof stress is high. Further, in No. 18-4, No. 18-5, No. 18-12, and No. 18-20, a small amount of the intermetallic compound existed before performing the annealing 2 and the annealing 2 was performed at 730° C. at which the intermetallic compound is not easily precipitated finely, so that the intermetallic compound existing before the annealing 2 increased and thus the high-temperature strength decreased.

In No. 18-8, the annealing 2 was only performed, so that the average crystal grain size of the α phase was less than 10 μm and thus the 0.2% proof stress was high. In No. 18-9, No. 18-11, No. 18-13, No. 18-14, No. 18-15, No. 18-17, No. 18-18, and No. 18-19, the hot-rolled sheet annealing was performed at a temperature equivalent to that of the annealing 1, but the annealing 1 was not performed, so that the average crystal grain size of the α phase was less than 10 μm and thus the 0.2% proof stress increased.

In No. 15-3 and No. 19-1, the temperature of the annealing 2 is 750° C., the precipitation of the intermetallic compound is insufficient, and the 0.2% proof stress is high.

In No. 19-2, the temperature of the annealing 2 is less than 550° C., so that the intermetallic compound is precipitated finely and the 0.2% proof stress is high. In No. 15-2, the holding time of the annealing 2 was short, so that the precipitation of the intermetallic compound was not sufficient and the 0.2% proof stress increased.

In No. 19-3, the annealing 1 was performed at 850° C., so that the 0 phase was generated and pinning hindered the growth of the α phase, and thus the average crystal grain size of the α phase was less than 10 μm. As a result, the 0.2% proof stress became 340 MPa or less by the precipitation of the intermetallic compound, but the elongation was less than 25%.

In No. 19-4, the temperature of the annealing 1 was less than 750° C., sufficient solid solution was impossible, the intermetallic compound pinned the growth of the α phase, and the average crystal grain size of the α phase was less than 10 μm. As a result, the 0.2% proof stress became 340 MPa or less by the precipitation of the intermetallic compound, but the elongation was less than 25%.

In No. 17-2, the annealing time of the annealing 1 was short, so that the grains were made fine, the strength became high, and further, the ductility became low.

In No. 29, the content of Ge was too large, so that a large amount of the intermetallic compound was precipitated and the elongation was less than 25%. In No. 30, the content of Bi is too large, so that the intermetallic compound is precipitated excessively and the elongation is less than 25%.

TABLE 1

| | CHEMICAL COMPOSITION (mass %) | | | | | | | | | HOT ROLLING | HOT-ROLLED SHEET ANNEALING | | COLD ROLLING COLD |
|---|---|---|---|---|---|---|---|---|---|---|---|---|---|
| No. | Cu | Sn | Si | Nb | Bi | Ge | Fe | O | OTHER IMPURITIES | TEMPERATURE (° C.) | TEMPERATURE (° C.) | TIME (min) | ROLLING RATIO (%) |
| 1-1 | 0.5 | 1.0 | 0.25 | 0.20 | — | — | 0.03 | 0.06 | 0.03 | 860 | — | — | 71.4 |
| 1-2 | 0.5 | 1.0 | 0.25 | 0.20 | — | — | 0.03 | 0.06 | 0.03 | 860 | — | — | 71.4 |
| 1-3 | 0.5 | 1.0 | 0.25 | 0.20 | — | — | 0.03 | 0.06 | 0.03 | 860 | — | — | 71.4 |
| 2-1 | 0.9 | 0.3 | 0.10 | 0.05 | — | — | 0.03 | 0.06 | 0.03 | 860 | — | — | 71.4 |
| 2-2 | 0.9 | 0.3 | 0.10 | 0.05 | — | — | 0.03 | 0.06 | 0.03 | 860 | — | — | 71.4 |
| 2-3 | 0.9 | 0.3 | 0.10 | 0.05 | — | — | 0.03 | 0.06 | 0.03 | 860 | — | — | 71.4 |
| 3-1 | 0.9 | 1.0 | 0.05 | 0.20 | — | — | 0.03 | 0.06 | 0.02 | 860 | — | — | 71.4 |
| 3-2 | 0.9 | 1.0 | 0.05 | 0.20 | — | — | 0.03 | 0.06 | 0.02 | 860 | — | — | 71.4 |
| 4 | 1.3 | 1.1 | 0.08 | 0.14 | — | — | 0.04 | 0.04 | 0.07 | 860 | — | — | 71.4 |
| 5-1 | 0.7 | 0.8 | 0.10 | 0.02 | — | — | 0.05 | 0.05 | 0.12 | 860 | — | — | 71.4 |
| 5-2 | 0.7 | 0.8 | 0.10 | 0.02 | — | — | 0.05 | 0.05 | 0.12 | 860 | — | — | 71.4 |
| 6-1 | 1.1 | 0.5 | 0.10 | 0.05 | — | — | 0.04 | 0.05 | 0.1 | 860 | — | — | 71.4 |
| 6-2 | 1.1 | 0.5 | 0.10 | 0.05 | — | — | 0.04 | 0.05 | 0.1 | 860 | — | — | 71.4 |
| 6-3 | 1.1 | 0.5 | 0.1 | 0.05 | — | — | 0.04 | 0.05 | 0.1 | 860 | — | — | 71.4 |
| 6-4 | 1.1 | 0.5 | 0.1 | 0.05 | — | — | 0.04 | 0.05 | 0.1 | 860 | — | — | 71.4 |
| 6-5 | 1.1 | 0.5 | 0.1 | 0.05 | — | — | 0.04 | 0.05 | 0.1 | 860 | — | — | 71.4 |
| 7 | 1.5 | 1.0 | 0.25 | 0.25 | — | — | 0.03 | 0.06 | 0.03 | 860 | — | — | 71.4 |
| 8 | 0.9 | 1.8 | 0.30 | 0.10 | — | — | 0.03 | 0.06 | 0.03 | 860 | — | — | 71.4 |
| 9 | 0.9 | 1.0 | 0.53 | 0.20 | — | — | 0.03 | 0.06 | 0.02 | 860 | — | — | 71.4 |
| 10 | 0.9 | 1.0 | 0.30 | 0.60 | — | — | 0.03 | 0.06 | 0.03 | 860 | — | — | 71.4 |
| 11 | 0.9 | 1.1 | 0.20 | 0.15 | — | — | 0.1 | 0.05 | 0.15 | 860 | — | — | 71.4 |
| 12 | 1.1 | 0.8 | 0.23 | 0.34 | — | — | 0.03 | 0.1 | 0.05 | 860 | — | — | 71.4 |
| 13 | 1.0 | 0.9 | 0.16 | 0.24 | — | — | 0.08 | 0.05 | 0.08 | 860 | — | — | 71.4 |
| 14 | 1.1 | 0.9 | 0.15 | 0.20 | — | — | 0.04 | 0.08 | 0.07 | 860 | — | — | 71.4 |
| 15-1 | 1.1 | 1.1 | 0.2 | 0.3 | — | — | 0.04 | 0.05 | 0.12 | 860 | — | — | 71.4 |
| 15-2 | 1.1 | 1.1 | 0.2 | 0.3 | — | — | 0.04 | 0.05 | 0.12 | 860 | — | — | 71.4 |
| 15-3 | 1.1 | 1.1 | 0.2 | 0.3 | — | — | 0.04 | 0.05 | 0.12 | 860 | — | — | 71.4 |
| 16-1 | 0.7 | 0.8 | 0.45 | 0.25 | — | — | 0.02 | 0.05 | 0.03 | 860 | — | — | 71.4 |
| 16-2 | 0.7 | 0.8 | 0.45 | 0.25 | — | — | 0.02 | 0.05 | 0.03 | 860 | — | — | 71.4 |
| 16-3 | 0.7 | 0.8 | 0.45 | 0.25 | — | — | 0.02 | 0.05 | 0.03 | 860 | — | — | 71.4 |
| 17-1 | 0.7 | 0.8 | 0.35 | 0.35 | — | — | 0.02 | 0.05 | 0.03 | 860 | — | — | 71.4 |
| 17-2 | 0.7 | 0.8 | 0.35 | 0.35 | — | — | 0.02 | 0.05 | 0.03 | 860 | — | — | 71.4 |

| | ANNEALING 1 | | ANNEALING 2 | |
|---|---|---|---|---|
| No. | TEMPERATURE (° C.) | TIME (min) | TEMPERATURE (° C.) | TIME (min) |
| 1-1 | 800 | 3 | 600 | 480 |
| 1-2 | 800 | 3 | — | — |
| 1-3 | — | — | 700 | 480 |
| 2-1 | 780 | 3 | 600 | 480 |
| 2-2 | 800 | 3 | — | — |
| 2-3 | — | — | 700 | 480 |
| 3-1 | 800 | 3 | 600 | 480 |
| 3-2 | 800 | 3 | — | — |
| 4 | 800 | 3 | 650 | 480 |
| 5-1 | 800 | 3 | 650 | 480 |
| 5-2 | 800 | 3 | 750 | 480 |
| 6-1 | 800 | 3 | 650 | 480 |
| 6-2 | 810 | 10 | 720 | 480 |
| 6-3 | 820 | 2 | 670 | 480 |
| 6-4 | 820 | 5 | 670 | 480 |
| 6-5 | 820 | 0.5 | 670 | 480 |
| 7 | 800 | 3 | 600 | 960 |
| 8 | 780 | 3 | 600 | 480 |
| 9 | 800 | 3 | 600 | 480 |
| 10 | 750 | 3 | 600 | 480 |

TABLE 1-continued

| | | | | |
|---|---|---|---|---|
| 11 | 800 | 3 | 650 | 480 |
| 12 | 800 | 3 | 650 | 480 |
| 13 | 800 | 3 | 650 | 480 |
| 14 | 800 | 3 | 650 | 480 |
| 15-1 | 800 | 3 | 550 | 480 |
| 15-2 | 800 | 3 | 550 | 230 |
| 15-3 | 800 | 3 | 750 | 240 |
| 16-1 | 800 | 3 | 600 | 480 |
| 16-2 | 800 | 3 | — | — |
| 16-3 | — | — | 600 | 480 |
| 17-1 | 800 | 3 | 600 | 480 |
| 17-2 | 800 | 0.5 | 600 | 480 |

TABLE 2

| | CHEMICAL COMPOSITION (mass %) | | | | | | | | | HOT ROLLING | HOT-ROLLED SHEET ANNEALING | | COLD ROLLING COLD |
|---|---|---|---|---|---|---|---|---|---|---|---|---|---|
| No. | Cu | Sn | Si | Nb | Bi | Ge | Fe | O | OTHER IMPURITIES | TEMPERATURE (° C.) | TEMPERATURE (° C.) | TIME (min) | ROLLING RATIO (%) |
| 18-1 | 0.9 | 1.0 | 0.27 | 0.25 | — | — | 0.02 | 0.05 | 0.02 | 860 | — | — | 71.4 |
| 18-2 | 0.9 | 1.0 | 0.27 | 0.25 | — | — | 0.02 | 0.05 | 0.02 | 860 | — | — | 71.4 |
| 18-3 | 0.9 | 1.0 | 0.27 | 0.25 | — | — | 0.02 | 0.05 | 0.02 | 860 | — | — | 71.4 |
| 18-4 | 0.9 | 1.0 | 0.27 | 0.25 | — | — | 0.02 | 0.05 | 0.02 | 860 | — | — | 71.4 |
| 18-5 | 0.9 | 1.0 | 0.27 | 0.25 | — | — | 0.02 | 0.05 | 0.02 | 860 | — | — | 71.4 |
| 18-6 | 0.9 | 1.0 | 0.27 | 0.25 | — | — | 0.02 | 0.05 | 0.02 | 860 | — | — | 71.4 |
| 18-7 | 0.9 | 1.0 | 0.27 | 0.25 | — | — | 0.02 | 0.05 | 0.02 | 860 | — | — | 71.4 |
| 18-8 | 0.9 | 1.0 | 0.27 | 0.25 | — | — | 0.02 | 0.05 | 0.02 | 860 | — | — | 71.4 |
| 18-9 | 0.9 | 1.0 | 0.27 | 0.25 | — | — | 0.02 | 0.05 | 0.02 | 860 | 800 | 2 | 71.4 |
| 18-10 | 0.9 | 1.0 | 0.27 | 0.25 | — | — | 0.02 | 0.05 | 0.02 | 860 | 800 | 2 | 71.4 |
| 18-11 | 0.9 | 1.0 | 0.27 | 0.25 | — | — | 0.02 | 0.05 | 0.02 | 860 | 800 | 2 | 71.4 |
| 18-12 | 0.9 | 1.0 | 0.27 | 0.25 | — | — | 0.02 | 0.05 | 0.02 | 860 | 800 | 2 | 71.4 |
| 18-13 | 0.9 | 1.0 | 0.27 | 0.25 | — | — | 0.02 | 0.05 | 0.02 | 860 | 800 | 2 | 71.4 |
| 18-14 | 0.9 | 1.0 | 0.27 | 0.25 | — | — | 0.02 | 0.05 | 0.02 | 860 | 800 | 2 | 71.4 |
| 18-15 | 0.9 | 1.0 | 0.27 | 0.25 | — | — | 0.02 | 0.05 | 0.02 | 860 | 770 | 3 | 71.4 |
| 18-16 | 0.9 | 1.0 | 0.27 | 0.25 | — | — | 0.02 | 0.05 | 0.02 | 860 | 720 | 2 | 71.4 |
| 18-17 | 0.9 | 1.0 | 0.27 | 0.25 | — | — | 0.02 | 0.05 | 0.02 | 860 | 720 | 2 | 71.4 |
| 18-18 | 0.9 | 1.0 | 0.27 | 0.25 | — | — | 0.02 | 0.05 | 0.02 | 860 | 720 | 2 | 71.4 |
| 18-19 | 0.9 | 1.0 | 0.27 | 0.25 | — | — | 0.02 | 0.05 | 0.02 | 860 | 720 | 2 | 71.4 |
| 18-20 | 0.9 | 1.0 | 0.27 | 0.25 | — | — | 0.02 | 0.05 | 0.02 | 860 | 640 | 20 | 71.4 |
| 18-21 | 0.9 | 1.0 | 0.27 | 0.25 | — | — | 0.02 | 0.05 | 0.02 | 860 | 780 | 2 | 71.4 |
| 18-22 | 0.9 | 1.0 | 0.27 | 0.25 | — | — | 0.02 | 0.05 | 0.02 | 860 | 780 | 2 | 71.4 |
| 19-1 | 0.7 | 1.0 | 0.30 | 0.10 | — | — | 0.03 | 0.06 | 0.03 | 860 | — | — | 71.4 |
| 19-2 | 0.7 | 1.0 | 0.30 | 0.10 | — | — | 0.03 | 0.06 | 0.03 | 860 | — | — | 71.4 |
| 19-3 | 0.7 | 1.0 | 0.30 | 0.10 | — | — | 0.03 | 0.06 | 0.03 | 860 | — | — | 71.4 |
| 19-4 | 0.7 | 1.0 | 0.30 | 0.10 | — | — | 0.03 | 0.06 | 0.03 | 860 | — | — | 71.4 |
| 19-5 | 0.7 | 1.0 | 0.30 | 0.10 | — | — | 0.03 | 0.06 | 0.03 | 860 | — | — | 71.4 |
| 20-1 | 0.8 | 1.5 | 0.15 | 0.10 | — | — | 0.04 | 0.04 | 0.09 | 860 | — | — | 71.4 |
| 20-2 | 0.8 | 1.5 | 0.15 | 0.10 | — | — | 0.04 | 0.04 | 0.09 | 860 | — | — | 71.4 |
| 21 | 1.2 | 1.2 | 0.40 | 0.30 | — | — | 0.02 | 0.05 | 0.03 | 860 | 800 | 2 | 71.4 |
| 22 | 0.9 | 1.0 | 0.40 | 0.50 | — | — | 0.03 | 0.06 | 0.03 | 860 | — | — | 71.4 |
| 23 | 1.0 | 1.0 | 0.28 | 0.30 | — | — | 0.02 | 0.05 | 0.03 | 860 | 780 | 2 | 71.4 |
| 24 | 1.0 | 1.0 | 0.10 | 0.30 | — | — | 0.02 | 0.05 | 0.03 | 860 | 780 | 2 | 71.4 |
| 25 | 0.9 | 1.0 | 0.35 | 0.30 | 0.5 | — | 0.03 | 0.06 | 0.03 | 860 | 780 | 5 | 71.4 |
| 26 | 0.9 | 1.0 | 0.35 | 0.30 | — | 0.5 | 0.03 | 0.06 | 0.03 | 860 | 780 | 5 | 71.4 |
| 27 | 0.9 | 1.0 | 0.35 | 0.30 | 0.5 | 1.5 | 0.03 | 0.06 | 0.03 | 860 | 800 | 1 | 71.4 |
| 28 | 0.9 | 1.0 | 0.35 | 0.30 | 2 | — | 0.03 | 0.06 | 0.03 | 860 | 750 | 5 | 71.4 |
| 29 | 0.9 | 1.0 | 0.35 | 0.30 | — | 2 | 0.03 | 0.06 | 0.03 | 860 | 800 | 1 | 71.4 |
| 30 | 0.9 | 1.0 | 0.35 | 0.30 | 2.5 | — | 0.03 | 0.06 | 0.03 | 860 | 750 | 5 | 71.4 |

| | ANNEALING 1 | | ANNEALING 2 | |
|---|---|---|---|---|
| No. | TEMPERATURE (° C.) | TIME (min) | TEMPERATURE (° C.) | TIME (min) |
| 18-1 | 800 | 3 | 600 | 480 |
| 18-2 | 800 | 1.5 | — | — |
| 18-3 | 800 | 3 | — | — |
| 18-4 | — | — | 730 | 600 |
| 18-5 | — | — | 730 | 480 |
| 18-6 | — | — | 770 | 300 |
| 18-7 | — | — | 750 | 60 |
| 18-8 | — | — | 680 | 480 |
| 18-9 | — | — | 680 | 480 |
| 18-10 | — | — | 780 | 30 |

TABLE 2-continued

| | | | | |
|---|---|---|---|---|
| 18-11 | — | — | 680 | 240 |
| 18-12 | — | — | 730 | 240 |
| 18-13 | — | — | 690 | 600 |
| 18-14 | — | — | 650 | 600 |
| 18-15 | — | — | 710 | 600 |
| 18-16 | — | — | 780 | 30 |
| 18-17 | — | — | 680 | 240 |
| 18-18 | — | — | 680 | 240 |
| 18-19 | — | — | 680 | 240 |
| 18-20 | — | — | 730 | 480 |
| 18-21 | 800 | 3 | 700 | 480 |
| 18-22 | 780 | 3 | — | — |
| 19-1 | 800 | 3 | 750 | 480 |
| 19-2 | 800 | 3 | 530 | 2400 |
| 19-3 | 850 | 3 | 600 | 480 |
| 19-4 | 730 | 3 | 600 | 960 |
| 19-5 | 780 | 3 | 600 | 480 |
| 20-1 | 800 | 3 | 650 | 480 |
| 20-2 | 780 | 1.5 | 650 | 480 |
| 21 | 800 | 3 | 600 | 480 |
| 22 | 750 | 3 | 600 | 480 |
| 23 | 800 | 3 | 600 | 480 |
| 24 | 800 | 3 | 600 | 480 |
| 25 | 800 | 3 | 600 | 480 |
| 26 | 800 | 3 | 600 | 480 |
| 27 | 800 | 3 | 600 | 480 |
| 28 | 800 | 3 | 600 | 480 |
| 29 | 800 | 3 | 600 | 480 |
| 30 | 800 | 3 | 600 | 480 |

TABLE 3

| No. | AVERAGE CRYSTAL GRAIN SIZE OF α PHASE (μm) | AREA FRACTION OF α PHASE (%) | AVERAGE GRAIN SIZE OF INTER-METALLIC COMPOUND (μm) | 0.2% PROOF STRESS AT ROOM TEMPERATURE (MPa) | FRACTURE ELONGATION AT ROOM TEMPERATURE (%) |
|---|---|---|---|---|---|
| 1-1 | 13.5 | 99.1 | 0.8 | 320 | 26.7 |
| 1-2 | 13.2 | 99.6 | 0.5 | 324 | 26.3 |
| 1-3 | 12.9 | 99.2 | 0.9 | 329 | 26.7 |
| 2-1 | 15.9 | 98.2 | 0.9 | 326 | 26.7 |
| 2-2 | 16.2 | 99.5 | 0.9 | 336 | 26.9 |
| 2-3 | 14.2 | 98.6 | 1.1 | 328 | 25.9 |
| 3-1 | 12.1 | 99.2 | 0.9 | 311 | 28.1 |
| 3-2 | 12.4 | 99.8 | 0.6 | 316 | 28.3 |
| 4 | 15.1 | 99 | 0.7 | 321 | 28.8 |
| 5-1 | 14.3 | 98.7 | 1.2 | 335 | 27.8 |
| 5-2 | 108 | 99.7 | 1.4 | 335 | 27.8 |
| 6-1 | 14.5 | 98.9 | 1.3 | 329 | 29.4 |
| 6-2 | 111 | 98.8 | 1.3 | 297 | 36.7 |
| 6-3 | 61 | 98.9 | 1.1 | 304 | 36.8 |
| 6-4 | 88 | 98.9 | 1.1 | 299 | 36.9 |
| 6-5 | 38 | 98.7 | 1.1 | 311 | 36.4 |
| 7 | 9.6 | 97.2 | 1.3 | 324 | 24.2 |
| 8 | 7.6 | 98.2 | 1.3 | 335 | 23.8 |
| 9 | 12.2 | 95.9 | 1.1 | 329 | 23.7 |
| 10 | 8.8 | 98.1 | 1.1 | 339 | 24.6 |
| 11 | 8.9 | 98.7 | 0.7 | 349 | 26.7 |
| 12 | 10.6 | 98.9 | 0.9 | 348 | 24.3 |
| 13 | 13.2 | 98.4 | 1.5 | 331 | 27.9 |
| 14 | 13.5 | 98.9 | 0.9 | 329 | 27.1 |
| 15-1 | 12.8 | 97.8 | 0.7 | 334 | 25.4 |
| 15-2 | 11.3 | 99.1 | 0.6 | 341 | 25 |
| 15-3 | 14.6 | 99.4 | 0.8 | 342 | 25.1 |
| 16-1 | 13.9 | 98.3 | 1.1 | 316 | 25.3 |
| 16-2 | 13.6 | 99.6 | 0.9 | 344 | 25.7 |
| 16-3 | 7.1 | 98.1 | 1.1 | 362 | 25.1 |
| 17-1 | 14.2 | 98.5 | 1.6 | 311 | 25.7 |
| 17-2 | 9.2 | 98.8 | 1.4 | 342 | 24.9 |

TABLE 3-continued

| No. | TENSILE STRENGTH AT 700° C. (MPa) | MAXIMUM OXIDATION INCREASE AT 800° C. FOR 100 hrs. (g/m2) | APPEARANCE | |
|---|---|---|---|---|
| 1-1 | 58 | 35.4 | A | COMPARATIVE EXAMPLE |
| 1-2 | 58 | 36.1 | A | COMPARATIVE EXAMPLE |
| 1-3 | 57 | 35.9 | A | COMPARATIVE EXAMPLE |
| 2-1 | 57 | 35.7 | A | COMPARATIVE EXAMPLE |
| 2-2 | 59 | 35.1 | A | COMPARATIVE EXAMPLE |
| 2-3 | 57 | 36.3 | A | COMPARATIVE EXAMPLE |
| 3-1 | 59 | 44.1 | A | COMPARATIVE EXAMPLE |
| 3-2 | 58 | 42.2 | A | COMPARATIVE EXAMPLE |
| 4 | 59 | 41.6 | A | COMPARATIVE EXAMPLE |
| 5-1 | 61 | 67.6 | A | COMPARATIVE EXAMPLE |
| 5-2 | 60 | 69.3 | D | COMPARATIVE EXAMPLE |
| 6-1 | 60 | 47.3 | A | INVENTION EXAMPLE |
| 6-2 | 61 | 46.9 | D | COMPARATIVE EXAMPLE |
| 6-3 | 60 | 48.6 | B | INVENTION EXAMPLE |
| 6-4 | 60 | 47.2 | C | INVENTION EXAMPLE |
| 6-5 | 60 | 48.3 | A | INVENTION EXAMPLE |
| 7 | 68 | 34.1 | A | COMPARATIVE EXAMPLE |
| 8 | 68 | 32.8 | A | COMPARATIVE EXAMPLE |
| 9 | 67 | 31.1 | A | COMPARATIVE EXAMPLE |
| 10 | 62 | 31.6 | A | COMPARATIVE EXAMPLE |
| 11 | 61 | 35.2 | A | COMPARATIVE EXAMPLE |
| 12 | 64 | 34.6 | A | COMPARATIVE EXAMPLE |
| 13 | 65 | 35.2 | A | INVENTION EXAMPLE |
| 14 | 63 | 36.2 | A | INVENTION EXAMPLE |
| 15-1 | 66 | 33.7 | A | INVENTION EXAMPLE |
| 15-2 | 64 | 33.5 | A | COMPARATIVE EXAMPLE |
| 15-3 | 67 | 34.2 | A | COMPARATIVE EXAMPLE |
| 16-1 | 65 | 32.5 | A | INVENTION EXAMPLE |
| 16-2 | 66 | 33.1 | A | COMPARATIVE EXAMPLE |
| 16-3 | 65 | 32.6 | A | COMPARATIVE EXAMPLE |
| 17-1 | 68 | 33.4 | A | INVENTION EXAMPLE |
| 17-2 | 65 | 33.6 | A | COMPARATIVE EXAMPLE |

TABLE 4

| No. | AVERAGE CRYSTAL GRAIN SIZE OF α PHASE (μm) | AREA FRACTION OF α PHASE (%) | AVERAGE GRAIN SIZE OF INTER-METALLIC COMPOUND (μm) | 0.2% PROOF STRESS AT ROOM TEMPERATURE (MPa) | FRACTURE ELONGATION AT ROOM TEMPERATURE (%) |
|---|---|---|---|---|---|
| 18-1 | 11.7 | 98.1 | 0.8 | 326 | 29.3 |
| 18-2 | 7.6 | 99.9 | 0.1 | 414 | 26.2 |
| 18-3 | 11.7 | 99.8 | 0.1 | 375 | 29.1 |
| 18-4 | 15.1 | 99.3 | 3.4 | 341 | 28.9 |
| 18-5 | 13.6 | 99.1 | 3.2 | 343 | 28.8 |
| 18-6 | 29.4 | 100 | — | 341 | 38.1 |
| 18-7 | 14.9 | 99.8 | 0.1 | 377 | 30.4 |
| 18-8 | 9.5 | 98.6 | 0.6 | 349 | 26.4 |
| 18-9 | 7.4 | 98.7 | 0.2 | 409 | 23.6 |
| 18-10 | 21.2 | 100 | — | 351 | 33.4 |
| 18-11 | 7.3 | 98.7 | 0.2 | 419 | 24.7 |
| 18-12 | 11.7 | 99.2 | 3.1 | 344 | 26.4 |
| 18-13 | 7.6 | 98.8 | 0.2 | 420 | 24.6 |
| 18-14 | 7.8 | 98.8 | 0.1 | 422 | 24.1 |
| 18-15 | 8.1 | 98.8 | 0.2 | 414 | 24.2 |
| 18-16 | 21.3 | 100 | — | 341 | 35.8 |
| 18-17 | 7.3 | 98.8 | 0.3 | 427 | 24.5 |
| 18-18 | 7.7 | 98.7 | 0.1 | 425 | 23.1 |
| 18-19 | 7.5 | 98.6 | 0.2 | 422 | 24.7 |
| 18-20 | 24.6 | 98.6 | 3.3 | 338 | 36.4 |
| 18-21 | 12.1 | 99 | 1.5 | 320 | 26.3 |
| 18-22 | 10.8 | 99.8 | 0.9 | 345 | 26.4 |
| 19-1 | 26.4 | 99.6 | 0.6 | 348 | 26.4 |
| 19-2 | 12.8 | 98.5 | 0.05 | 342 | 25.8 |
| 19-3 | 9.4 | 98.2 | 1.2 | 330 | 24.6 |
| 19-4 | 8.9 | 97.7 | 1.5 | 316 | 24.8 |
| 19-5 | 13.4 | 98.7 | 0.7 | 319 | 26.7 |
| 20-1 | 14.3 | 98.7 | 0.8 | 332 | 28.4 |

TABLE 4-continued

| | | | | | |
|---|---|---|---|---|---|
| 20-2 | 10 | 98.6 | 0.9 | 334 | 27.6 |
| 21 | 13.4 | 97.8 | 1.5 | 324 | 25.4 |
| 22 | 11.2 | 98.7 | 1.1 | 326 | 25.9 |
| 23 | 12.1 | 98.1 | 1.2 | 319 | 26.2 |
| 24 | 12.1 | 98.6 | 1.4 | 326 | 26.2 |
| 25 | 11.9 | 97.7 | 1.4 | 317 | 25.6 |
| 26 | 13.2 | 97.5 | 1.3 | 316 | 25.1 |
| 27 | 13.1 | 96.3 | 1.2 | 324 | 25.7 |
| 28 | 12.8 | 96.5 | 1.1 | 322 | 25.3 |
| 29 | 12.1 | 95.9 | 1.3 | 326 | 23.1 |
| 30 | 11.5 | 95.8 | 1.2 | 324 | 22.4 |

| No. | TENSILE STRENGTH AT 700° C. (MPa) | MAXIMUM OXIDATION INCREASE AT 800° C. FOR 100 hrs. (g/m2) | APPEARANCE | |
|---|---|---|---|---|
| 18-1 | 68 | 33.5 | A | INVENTION EXAMPLE |
| 18-2 | 67 | 32.9 | A | COMPARATIVE EXAMPLE |
| 18-3 | 65 | 34.1 | A | COMPARATIVE EXAMPLE |
| 18-4 | 59 | 35.1 | A | COMPARATIVE EXAMPLE |
| 18-5 | 59 | 33.2 | A | COMPARATIVE EXAMPLE |
| 18-6 | 70 | 33.7 | A | COMPARATIVE EXAMPLE |
| 18-7 | 67 | 33.1 | A | COMPARATIVE EXAMPLE |
| 18-8 | 66 | 32.9 | A | COMPARATIVE EXAMPLE |
| 18-9 | 70 | 34.2 | A | COMPARATIVE EXAMPLE |
| 18-10 | 68 | 33.7 | A | COMPARATIVE EXAMPLE |
| 18-11 | 69 | 33.9 | A | COMPARATIVE EXAMPLE |
| 18-12 | 59 | 34.5 | A | COMPARATIVE EXAMPLE |
| 18-13 | 66 | 34.8 | A | COMPARATIVE EXAMPLE |
| 18-14 | 71 | 34.9 | A | COMPARATIVE EXAMPLE |
| 18-15 | 66 | 34.8 | A | COMPARATIVE EXAMPLE |
| 18-16 | 68 | 33.7 | A | COMPARATIVE EXAMPLE |
| 18-17 | 71 | 33.2 | A | COMPARATIVE EXAMPLE |
| 18-18 | 70 | 33.8 | A | COMPARATIVE EXAMPLE |
| 18-19 | 65 | 34.1 | A | COMPARATIVE EXAMPLE |
| 18-20 | 59 | 34.4 | A | COMPARATIVE EXAMPLE |
| 18-21 | 66 | 33.7 | A | INVENTION EXAMPLE |
| 18-22 | 67 | 33.5 | A | COMPARATIVE EXAMPLE |
| 19-1 | 68 | 33.7 | A | COMPARATIVE EXAMPLE |
| 19-2 | 64 | 34.1 | A | COMPARATIVE EXAMPLE |
| 19-3 | 63 | 33.5 | A | COMPARATIVE EXAMPLE |
| 19-4 | 65 | 33.8 | A | COMPARATIVE EXAMPLE |
| 19-5 | 63 | 33.1 | A | INVENTION EXAMPLE |
| 20-1 | 63 | 36.1 | A | INVENTION EXAMPLE |
| 20-2 | 64 | 36.3 | A | INVENTION EXAMPLE |
| 21 | 63 | 33.4 | A | INVENTION EXAMPLE |
| 22 | 65 | 32.6 | A | INVENTION EXAMPLE |
| 23 | 64 | 32.9 | A | INVENTION EXAMPLE |
| 24 | 65 | 33.7 | A | INVENTION EXAMPLE |
| 25 | 68 | 33.6 | A | INVENTION EXAMPLE |
| 26 | 64 | 33.1 | A | INVENTION EXAMPLE |
| 27 | 70 | 32.9 | A | INVENTION EXAMPLE |
| 28 | 71 | 32.8 | A | INVENTION EXAMPLE |
| 29 | 72 | 33.5 | A | COMPARATIVE EXAMPLE |
| 30 | 72 | 33.1 | A | COMPARATIVE EXAMPLE |

What is claimed is:

1. A titanium alloy material comprising: in mass %,

Cu: 0.7% to 1.4%;

Sn: 0.5% to 1.5%;

Si: 0.10% to 0.45%;

Nb: 0.05% to 0.50%;

Fe: 0.00% to 0.08%;

O: 0.00% to 0.08%; and the balance: Ti and impurities, wherein in a structure, an area fraction of an α phase is 96.0% or more and 99.0% or less and an area fraction of an intermetallic compound is 1.0% or more and 4.0% or less, an average crystal grain size of the α phase is 10.0 μm or more and 100.0 μm or less and an average grain size of the intermetallic compound is 0.10 to 3.00 μm, and fracture elongation at 25° C. is 25.0% or more, 0.2% proof stress at 25° C. is 340 MPa or less, and a tensile strength at 700° C. is 60 MPa or more.

2. The titanium alloy material according to claim 1, further comprising: one or both of in mass %, Bi: 0.1 to 2.0%; and Ge: 0.1 to 1.5%, wherein a total content of one or both of Bi and Ge is less than 3.0%.

* * * * *